US007048274B2

(12) United States Patent
Duncombe et al.

(10) Patent No.: US 7,048,274 B2
(45) Date of Patent: May 23, 2006

(54) CASINO CARD GAME

(75) Inventors: Michael Duncombe, Carlton (AU); Jeff Lee, Essendon (AU)

(73) Assignee: 4F Investments Pty Limited, Sydney (AU)

( * ) Notice: Subject to any disclaimer, the term of this patent is extended or adjusted under 35 U.S.C. 154(b) by 91 days.

(21) Appl. No.: 10/468,595

(22) PCT Filed: Feb. 21, 2002

(86) PCT No.: PCT/AU02/00180

§ 371 (c)(1),
(2), (4) Date: Oct. 20, 2003

(87) PCT Pub. No.: WO02/066127

PCT Pub. Date: Aug. 29, 2002

(65) Prior Publication Data

US 2004/0066001 A1 Apr. 8, 2004

(30) Foreign Application Priority Data

Feb. 22, 2001 (AU) ..... PR3274

(51) Int. Cl.
*A63F 1/00* (2006.01)

(52) U.S. Cl. ..... 273/274; 273/292

(58) Field of Classification Search ..... 273/274, 273/309, 292

See application file for complete search history.

(56) References Cited

U.S. PATENT DOCUMENTS

| | | | | |
|---|---|---|---|---|
| 3,667,757 | A * | 6/1972 | Holmberg | 273/274 |
| 3,998,462 | A * | 12/1976 | Goott | 273/274 |
| 4,222,572 | A | 9/1980 | Baker | |
| 4,362,303 | A * | 12/1982 | Pell | 273/274 |
| 5,431,407 | A | 7/1995 | Hofberg et al. | |
| 5,713,573 | A | 2/1998 | Nazaryan | |
| 5,918,884 | A | 7/1999 | DiMuro | 273/292 |
| 5,944,316 | A | 8/1999 | Hernandez | |
| 6,102,403 | A | 8/2000 | Kaufman | |
| 6,428,002 | B1 * | 8/2002 | Baranauskas | 273/236 |
| 6,439,573 | B1 * | 8/2002 | Sklar | 273/292 |
| 6,547,246 | B1 * | 4/2003 | Webb | 273/292 |
| 6,550,772 | B1 * | 4/2003 | Streeks et al. | 273/292 |

FOREIGN PATENT DOCUMENTS

AU 711529 10/1999

* cited by examiner

*Primary Examiner*—William M. Pierce
(74) *Attorney, Agent, or Firm*—Baker & Daniels

(57) ABSTRACT

A method of gambling on a card game, said game being played with one or more conventional 52 card decks, comprising the steps of: players placing wagers on the next drawn card meeting a predetermined card outcome condition; a dealer drawing one card from a shuffled deck or decks; and the dealer paying said wagers, on the basis of the card having a face value that meets said predetermined outcome condition.

6 Claims, 2 Drawing Sheets

CASINO CARD GAME

BACKGROUND OF THE INVENTION

The present invention relates to a card-based game for casino and on-line gambling.

Casino games generally include both electronic gaming machines, and table based games. The latter include game such as Black Jack, Roulette, Craps and Baccarat. Many of these games have evolved elaborate conventions, which whilst well understood by experienced players, are intimidating to new table game players. Further, these games have rules, which may be simple once understood, but take some time to learn. For many players there is a fear that they will make a mistake and either appear foolish to the other players and staff, or lose their money unnecessarily. As a result, many players only play electronic gaming machines, as they can make a mistake without embarrassment.

Casino operators in some cases have a larger entitlement to gaming tables than they can utilise economically. In parallel, the numbers of gaming machines are capped. It is accordingly economically attractive to attract machine players to table games, in order to maximise the turnover of the casino.

Further, the profitability of a given table is determined by the costs incurred on the table, relative to the turnover and margins that are available. For example, in games such as blackjack and roulette, a relatively high level of supervision is required. This is because the dealer's responsibilities include calculation of wins and losses and payouts, while continually ensuring proper play. Additionally, the dealer can only service a limited number of players.

Also, as the card shoe is typically emptied relatively often due to the number of cards in play in each hand (often 20 or more cards per deal for 7 players and the dealer), substantial time is taken up in shuffling and preparing for a new card shoe to be used.

It is an object of the present invention to provide a simple, easily understood table game, which allows for relatively rapid play.

SUMMARY OF THE INVENTION

According to one aspect, the present invention provides a method of operating a casino card game, said game being played with one or more conventional 52 card decks, and a suitably marked playing surface, comprising the steps of:

Players placing wagers on the next drawn card meeting a predetermined card face value outcome condition;

drawing one card from a shuffled deck or decks; and paying said wagers, on the basis of the card having a face value that meets said predetermined outcome condition.

Preferably, the predetermined card outcome condition is that the face value of the card is either:

equal to a set value;

higher than a set value; or lower than a set value.

Preferably, the set value is seven.

Alternatively, the wager may be on the suit of the next drawn card.

Alternatively, the wager may be on the value of each of a series of next drawn cards. For example, the player may bet on a run of cards lower than seven, or a run of cards higher than seven.

Alternatively, the wager may be that the series of next drawn cards conforms to a set sequence. For example, the player may bet that the next five cards conform to well-known poker sequences, such as a Flush, Full House, Four-of-a-Kind, Five-of-a-Kind (for multiple pack dealing), Straight Flush or Royal Flush.

Other betting options may relate to the outcome of more than one specific game. The system may be fully manually dealt, partly electronic or fully electronic, for example in a gaming machine. The game may be played in person or via the internet or other remote interaction mechanisms.

According to another aspect of the invention, there is provided a card game, wherein the object of the game is to predict whether the next drawn card will meet a predetermined outcome condition; and wherein the predetermined outcome condition is that the face value of the card is:

equal to a set value;

higher than a set value;

lower than a set value; or of a particular suit.

As per the methods described above, the game may additionally involve other predictions, such as runs of high and low face values, runs of cards forming familiar poker hands, runs of suits etc.

Preferably, the game is presented in the manner of traditional casino table-games, wherein a marked playing table is provided that has spaces marked for the placing of cards and bets, usually in the form of chips. A dealer is also provided, who deals actual playing cards, supervises play and collects and pays the wagers.

The present invention accordingly provides a very simple game. The dealer does not need to add the value of cards or perform complex calculations. In a preferred form, high and low are paid at even money, and a successful wager on the set value card is paid at higher returns, e.g. the seven is paid at 11:1. In another preferred form, successful high or low bets, where the card drawn has a particularly high or low value, may be paid at higher returns, e.g. Ace (low) and King (high) paid at 3:2; two (low) and Queen (high) paid at 6:5.

As only one card is drawn, which is not touched by the players, the opportunities for cheating are small. A further advantage is that play is very fast—once bets are placed, the card is dealt, and wins and losses are immediately apparent. Further, as no choices are being made, the opportunities for card counting and the like are very small.

A further advantage is that as the rules are simple, it is likely to attract those who may be intimidated by existing table games. No elaborate strategies or systems need to be learned by players to enjoy the game.

The present invention is also readily able to be implemented using electronic systems, Particularly in this form, it would be possible to have jackpot bets on specified outcomes across multiple draws, for example on multiples of the same card being drawn in succeeding games, runs of low or high values, runs of suits etc.

DESCRIPTION OF PREFERRED EMBODIMENT

Figure 1:
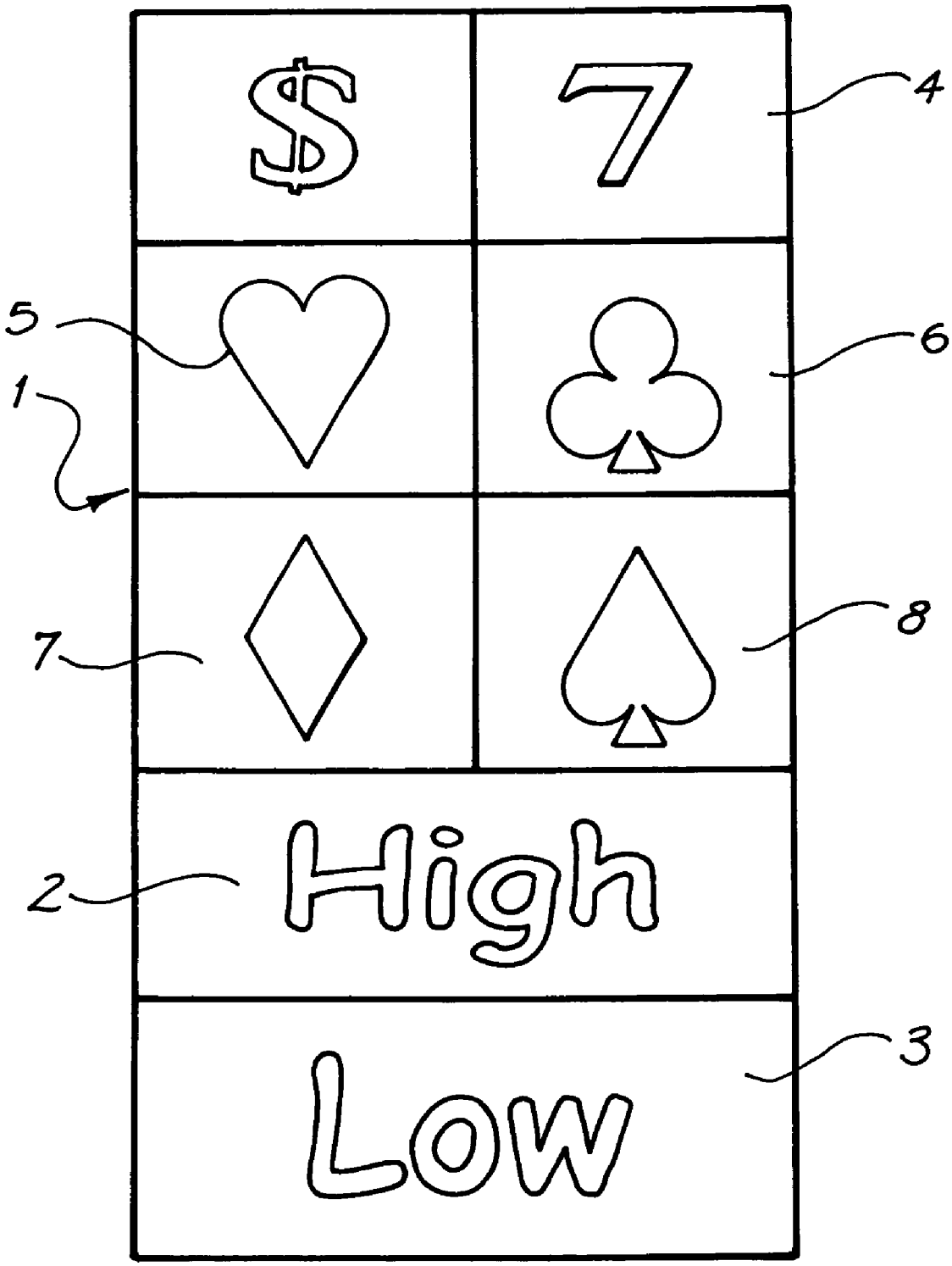
FIG. 1 shows the layout of an individual player betting box.

The rules of the illustrative game are simple. The object is for the player to place a successful wager on the outcome of a single card draw. The wagers are placed, preferably within betting boxes defined in front of each player. As illustrated in figure 1, the bet may be placed in the betting box 1 on the symbol relating to the wager. A bet that the card drawn will be higher than seven will be placed on the 'high' box 2. A bet that the card drawn will be lower than seven will be placed on the 'low' box 3. A bet that the card drawn will be a seven will be placed on the 'seven' box 4. Bets that the card will be of a particular suit will be placed on the 'hearts' box 5, the 'clubs' box 6, the 'diamonds' box 7 and/or the 'spades' box 8.

The dealer draws one card from a shoe. It is preferred that a single deck be used, which is shuffled after a maximum of five cards are dealt. Alternatively, the shoe could be a multiple deck continuous shuffling type. If the card drawn is low, then low bets are paid at even money. If a high card is drawn, then high bets are paid at even money. However, if the card is an ace or king, then the respective low and high bets are paid at 3:2. Low and high bets all lose if a seven is drawn. This provides a percentage win to the house of about 3.8%. If the card is a queen or a two, then the respective high or high bets are paid at 6:5. This provides a percentage win to the house of about 2.3%.

If a seven if drawn, this bet pays at either 10:1 or 11:1, depending on the win percentage desired by the house. At 11:1, the house advantage is about 7.7%.

The shoe could be of regular type, as is used for other casino games. In this case, the cards should be cut, at between one half and seven eighths. Alternatively, the shoe could be of the continuous shuffling type.

As for other games, the house would preferably set minimum and maximum bets. As well or alternatively, the house could apply a limit to the maximum table risk per hand—that is, the difference between low and high bets—in a similar manner to that used in some casinos for banker/player bets on baccarat.

Other betting options can be provided. One example is suit betting. The player bets that the next suit drawn will be the one he has selected. All wagers are paid at 3:1, unless a seven of the nominated suit is drawn, which results in a reduced payout of 3:2. This provides a percentage win to the house of abour 2.88%. All wagers otherwise lose if a seven is dealt. Optionally, Aces and Kings may be paid at 7:2.

Another example is field betting. This may be, for example, a set of 6 numbers other than the high/low numbers—e.g. ace, 2, 3, jack, queen, king, with an even money payout. Various such combinations, with different payouts, could be provided.

Figure 2:
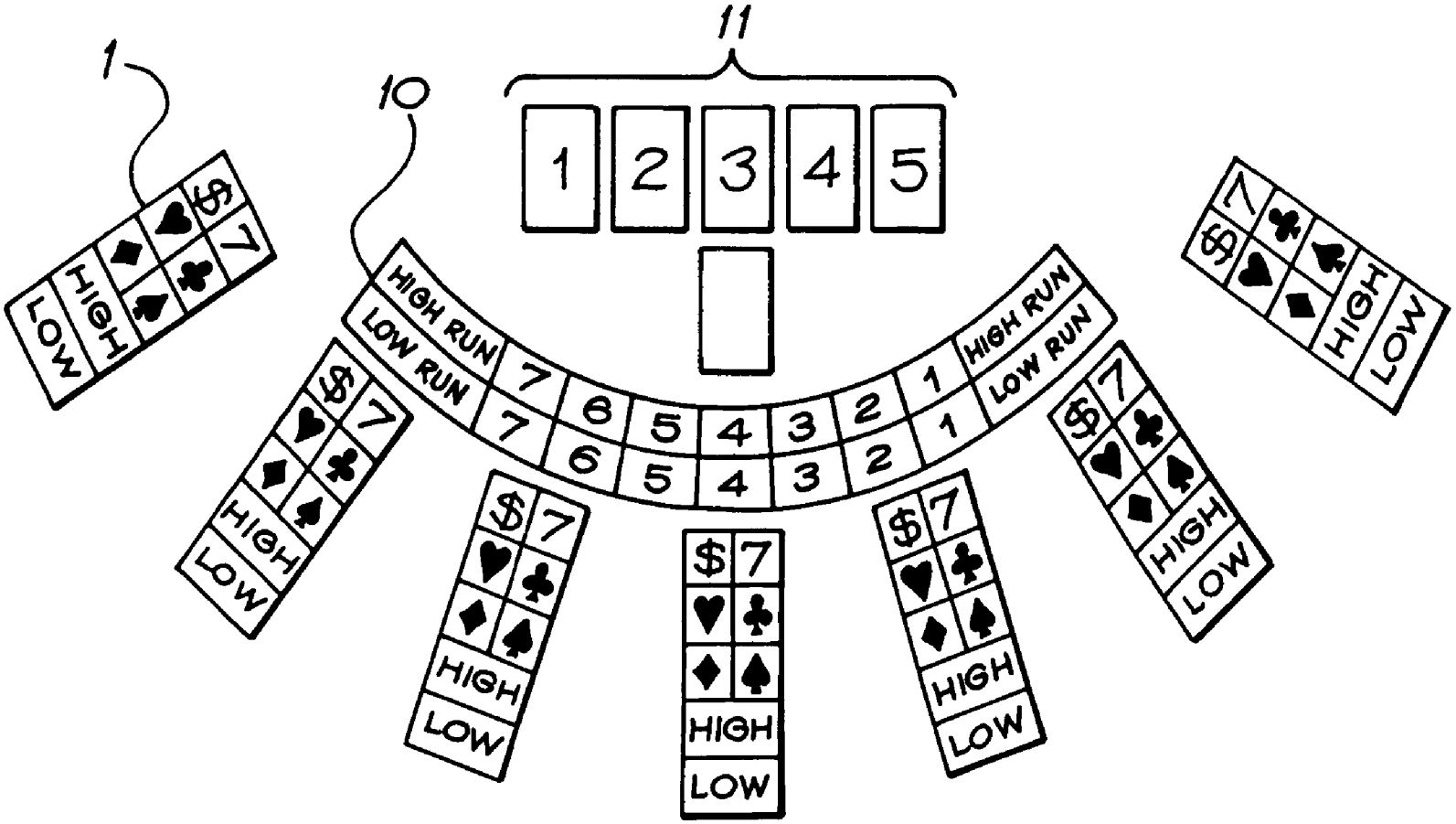
FIG. 2 illustrates a possible gaming table layout.

FIG. 2 shows a table layout, with positions for 7 players 1 and a dealer 9. Each player has a betting box 1 in front of them, with places to lay bets on high cards, low cards, sevens and individual suits. A 'run' bet area 10 is provided for placing bets on runs of up to five high or low cards.

Bets could also be made on a jackpot basis, on the outcomes of more than one game. This requires record keeping, for example placement of the previous five cards on the playing area in the jackpot area 11. The multiple bets could be, for example, that 3 cards of the same value (e.g. aces) are dealt in the specified games, in succession or within some designated number of games. It could require that the cards in successive games have a particular relationship—for example, that they form a poker or blackjack hand of better than some specified value. The simplicity of each hand lends itself to further elaborations for multi-game play as required.

It will be appreciated that the present invention is capable of implementation in many forms within the general inventive concept disclosed.

Variations and additions are possible within the spirit and scope of the invention, as will be apparent to those skilled in the art.

RULES

1. Only one player is permitted to wager on each betting area.
2. A player shall not wager on more than one betting box on any round.
3. The dealer shall call 'no more bets' prior to handling the hand held shoe.
4. A card found 'face up' (boxed) shell be burnt, and wagers for that round shall be deemed void.
5. If it is discovered that the deck in use does not contain 52 regular playing cards, the round of play shall be deemed void.
6. If the dealer draws a fourth or fifth card when not required (under the rules of RUN wager and JACKPOT bet) all bets on HIGH/LOW, SUIT, and SEVEN are considered 'live' and paid or taken accordingly.
   a) Any monies wagered on the JACKPOT or RUN areas after the third or fourth card but prior to the additional overdrawn card/s are to be returned.
   b) The JACKPOT and RUN wagers will not reopen until a shuffle takes place.
7. If more than one card is drawn from the shoe simultaneously at the point of the initial deal (the first card after a shuffle) the deck is to be reshuffled.
   a) Players may change or rearrange their wagers.
   b) JACKPOT wagers are to be returned (if desired by player/s).
8. If more than one card is drawn from the shoe simultaneously during the subsequent deal (any time after the first card has moved to the 'jackpot holding area') and it cannot be determined which is the next card, then all remaining cards are reshuffled and the hand continues.
9. If the first four cards drawn are 7's (one deck only)
   a) A fifth card would not be drawn.
   b) JACKPOT four of a kind would be paid.

The invention claimed is:

1. A method of operating a casino card game, said game being played with one or more decks of cards, a dealer and players, including the steps of:

(a) providing a playing surface, said surface including first marked areas for placing wagers on one or more aspects of the face value of a single card, and second marked areas for placing wagers on one or more aspects of the face values of a plurality of successively dealt single cards, wherein said one or more aspects of the face values of a plurality of successively dealt cards include one or more of the following poker hands formed from five successively dealt cards:
   a flush;
   a full house;
   four of a kind;
   five of a kind;
   a straight flush; and
   a royal flush;

(b) permitting the players to place wagers in said first and second marked areas;

(c) the dealer dealing a single card;

(d) the dealer collecting and paying the wagers placed in the first marked areas according to the face value of said card;

(e) permitting players to place new wagers in said first marked areas; and (f) repeating steps (c) to (e) the dealer collecting and paying the wagers placed in the second marked areas according to the face values of the successively dealt single cards in step (c).

2. The method of claim 1, wherein the game is wholly or partly presented in electronic form.

3. The method of claim 1, wherein said one or more aspects of the face value of a single card include:

a value equal to a set value;

a value higher than a set value;

a value lower than a set value; or a card of a particular suit.

4. The method of claim 3, wherein the game is wholly or partly presented in electronic form.

5. The method of claim 3, wherein the set value is seven.

6. The method of claim 5, wherein the game is wholly or partly presented in electronic form.

* * * * *